US006475309B1

(12) United States Patent
Fogelstrom et al.

(10) Patent No.: US 6,475,309 B1
(45) Date of Patent: Nov. 5, 2002

(54) ROLLING BEARING STEEL HAVING A SURFACE WITH A LOWER BAINITIC STRUCTURE AND A METHOD FOR THE PRODUCTION THEREOF

(75) Inventors: Joacim Fogelstrom, Billdal (SE); John Michael Beswick, Montfoort (NL); Aldan Michael Kerrigan, Utrecht (NL); Han Ingemar Strandell, Savedalen (SE)

(73) Assignee: SKF Engineering & Research Centre B.V. (NL)

( * ) Notice: Subject to any disclaimer, the term of this patent is extended or adjusted under 35 U.S.C. 154(b) by 0 days.

(21) Appl. No.: 09/937,153

(22) PCT Filed: Apr. 7, 2000

(86) PCT No.: PCT/NL00/00229

§ 371 (c)(1),
(2), (4) Date: Sep. 28, 2001

(87) PCT Pub. No.: WO00/63450

PCT Pub. Date: Oct. 26, 2000

(30) Foreign Application Priority Data

Apr. 15, 1999 (NL) ..... 1011806

(51) Int. Cl.[7] ..... C21D 8/00; C21D 9/40; C22C 38/18

(52) U.S. Cl. ..... 148/589; 148/652; 148/906

(58) Field of Search ..... 148/589, 572, 148/906, 652, 651; 384/492, 912

(56) References Cited

U.S. PATENT DOCUMENTS 4,225,365 A * 9/1980 Rice ..... 148/664

FOREIGN PATENT DOCUMENTS

| | | |
|---|---|---|
| EP | 0 896 068 A1 | 2/1999 |
| GB | 2 019 436 A | 10/1979 |
| GB | 1 590 113 A | 5/1981 |
| GB | 1 590 114 A | 5/1981 |

OTHER PUBLICATIONS

Kulakov et al., "Kinetics of austenite transformation and internal stresses in bainitic hardening of bearing steel", Metal Science and Heat Treatment, vol. 28, Nos. 3–4, Elmont, New York, USA pp. 255–257, Apr. 3, 1986.

Von Bergen et al., "Effect of lower bainite on rolling contact fatigue of bearing steels", Proc. Int. Conf., Liverpool, pp. 105–110, Sep. 21–24, 1981.

Hengerer et al., "Zwischenstufenumwandlung von Walzlagerstahlen", Haerterei Technische Mitteilungen, vol. 29, No. 2, Jun. 1974, pp. 71–79.

* cited by examiner

*Primary Examiner*—Deborah Yee
(74) *Attorney, Agent, or Firm*—Oliff & Berridge, PLC

(57) ABSTRACT

A method for producing a rolling bearing component, in which, before ustenizing, the steel is subjected to cold deformation and quenching is such that the bainitic structure is obtained; and a rolling bearing component produced by the method, such as a rolling bearing ring from 1C to 1,5Cr type series steel, in which at least the surface of the rolling bearing component has a bainitic structure and the service life of the bainitic structure is considerably increased over a component not subjected to cold rolling.

9 Claims, No Drawings

ROLLING BEARING STEEL HAVING A SURFACE WITH A LOWER BAINITIC STRUCTURE AND A METHOD FOR THE PRODUCTION THEREOF

The invention relates to a rolling bearing steel from the 1C–1,5 Cr type series. Such steel comprises, generally, the following composition:

Carbon: 0.85–1.10 by weight %
Silicon: 0.005–0.6 by weight %
Manganese: 0.005–0.80 by weight %
Chromium 1.25–2.05 by weight %
Nickel: 0.35 max by weight %
Molybdenum 0.36 max by weight %
Balance Fe and usual impurities.

Steels comprising this composition are widely used in the production of rolling bearing components. Starting from a ferritic structure, the steel is subjected to an austenizing heat treatment, after which a quenching treatment results in a final component having a martensitic surface structure. This martensitic structure is relatively hard and has good basic properties. Applications for which the rolling contact fatigue life and toughness are of interest, carburised steels are used. The carburising steels and heat treatments are more costly, and the related heat treatments are generally much more complicated.

EP 0896068A1 discloses a method of bainite hardening of a bearing steel. To that end the starting material is in ferritic condition. The ferric steel is austenized and then quencehed, resulting in a bainitic final structure.

The invention aims to obtain a steel with improved properties, and more particularly, having improved rolling contact fatigue and good toughness properties.

According to the invention, this goal is realized by subjecting the ferritic steel to a deformation. This deformation can either be warm or cold. If warm deformation is used, preferably a deformation in the ferrite phase, i.e., of a temperature below 700° C., takes place. During warm deformation the dislocation cells obtained during deformation recover to form fine sub grains, during heating to the hardening temperature, and therefore a finer structure is obtained as a result of the applied lower bainitic hardening process.

Preferably, the steel is subjected to shaping by rolling. More preferable, if a ring has to be produced as a rolling bearing component starting from a tube, cold deformation is effected, during which the ring itself is produced from the tube with less metal cutting operations. This means that there is less material loss. It has been found that if cold rolling is used, the austenite start and the austenite finish temperature will decrease, i.e., the transformation from ferrite to austenite will be at a lower temperature level, and will be more complete at the same temperature level. The bainitic transformation time is preferably at least 180 minutes. Except from lowering the austenizing temperatures by rolling, and more particular cold rolling, the martensite start temperature is also lowered by about 30° C. and well below 250° C. Generally, the microstructure shows a much-refined grain. Preferably, the bainite comprises lower bainite which results in an extra extension of the service life of rolling bearing components made from such steel.

It is, of course, possible to start from another article as a tube at deformation. For example, parts or rings are mentioned, possibly followed by a pri shaping process (turning, milling). Cold forming can comprise rolling, forging, shaping and so on.

The ferrite subgrain boundaries are probably austenite nuclination sites at the intersections with spheroidal carbides, which result in refinement of the austenite grain size compared to undeformed 1C–1.5 Cr austenized under the same conditions.

The steel used is preferably relatively pure, i.e., comprises 9 ppm oxygen max, 0.004 wt % sulphur max. 15 ppm titanium max and 0.015 wt % phosphorus max.

To show the beneficial effect of cold rolling relative to hot rolling when producing a rolling bearing ring, comparative tests have been conducted. Apart from either the hot rolling or cold rolling, the heat treatment in both samples has been exactly the same. It has been shown that, in a spherical roller bearing, the relative L10 life of the hot rolled variant is 106 with 95 upper and lower confidence interval of 52–157 million revolutions.

Under the same test condition, a cold rolled ring had an L10 life of more than 294 million revolutions. Although not essential for the scope of protection for the invention, it is meant that, because of cold rolling of the ferritic matrix, dislocations recover to cells resulting in sub grain formation. This sub grain formation will lead to finer austenite. Quenching starts from the temperature above martensite start.

The treatment described above is an alternative for a rolling bearing steel having a generally lower carbon content to increase the rolling contact fatigue life. Such steel will generally be carburised or carbonitrided to increase the surface hardness to a sufficient level. The % deformation will have an effect on the size of the austenite grains obtained during the austenitizing treatment. A relatively low deformation will result in a coarse material having a grain size of several $\mu$m. However, if considerable deformation is used, for example more than 30% and more particular more than 60% the grain size will decrease considerably to below 2 $\mu$m.

It is noted that the scope of protection is not limited to the embodiments given in the description but is determinedby the appended claims.

What is claimed is:

1. Method for producing a 1C–1.5 Cr steel roller bearing ring, comprising:

providing a tube blank having ferritic matrix structure;

cold rolling the tube with a deformation of at least 30% at a temperature below 700° C.;

separating said tube into rings;

austenizing said rings; and quenching said rings, such that a bainitic structure results;

wherein the steel rolling bearing ring produced by the method comprises, in weight %: 0.85–1.10 carbon, 0.005–0.6 silicon, 0.005–0.80 manganese, 1.25–2.05 chromium, 0.35 max nickel, 0.36 max molybdenum, and balance Fe and usual impurities.

2. Method according to claim 1, wherein said austenizing temperature is between 800 and 900° C.

3. Method according to claim 1, wherein said quenching temperature is below 250° C.

4. Method according to claim 1, wherein said quenching results in a lower bainite structure.

5. Method according to claim 2, wherein said quenching results in a lower bainite structure.

6. Method according to claim 3, wherein said quenching results in a lower bainite structure.

7. Rolling bearing steel produced by the method according to claim 1, wherein at least the surface comprises a bainitic structure and does not comprise martensite.

8. Rolling bearing component produced from the rolling bearing steel according to claim 7.

9. Rolling bearing component according to claim 7 comprising a spherical roller bearing component.

* * * * *